US010119207B2

(12) United States Patent
Casanova Royo

(10) Patent No.: US 10,119,207 B2
(45) Date of Patent: Nov. 6, 2018

(54) DENIM FABRIC WITH FIRE-RETARDANT PROPERTIES AND PROCESS OF DYEING THE WARP WITH INDIGO BLUE DYE

(71) Applicant: TEJIDOS ROYO, S.L., Picassent (Valencia) (ES)

(72) Inventor: Jose Ignacio Casanova Royo, Picassent (Valencia) (ES)

(73) Assignee: TEJIDOS ROYO, S.L., Picassent (Valencia) (ES)

( * ) Notice: Subject to any disclaimer, the term of this patent is extended or adjusted under 35 U.S.C. 154(b) by 126 days.

(21) Appl. No.: 15/024,497

(22) PCT Filed: Sep. 12, 2014

(86) PCT No.: PCT/ES2014/070696

§ 371 (c)(1),
(2) Date: Mar. 24, 2016

(87) PCT Pub. No.: WO2015/049401

PCT Pub. Date: Apr. 9, 2015

(65) Prior Publication Data

US 2016/0230316 A1 Aug. 11, 2016

(30) Foreign Application Priority Data

Oct. 4, 2013 (ES) ..... 201331462

(51) Int. Cl.

| | |
|---|---|
| ***D03D 15/12*** | (2006.01) |
| ***D06P 3/82*** | (2006.01) |
| ***D03D 1/00*** | (2006.01) |
| ***D06P 1/22*** | (2006.01) |
| ***D03D 15/00*** | (2006.01) |

(52) U.S. Cl.

CPC ..... *D03D 15/12* (2013.01); *D03D 1/0035* (2013.01); *D03D 1/0041* (2013.01); *D03D 15/0033* (2013.01); *D06P 1/228* (2013.01); *D06P 3/82* (2013.01); *D10B 2201/00* (2013.01)

(58) Field of Classification Search

CPC .. D03D 15/12; D03D 15/0033; D03D 1/0035; D03D 1/0041; D06P 3/82; D06P 1/228; D10B 2201/00

See application file for complete search history.

(56) References Cited

U.S. PATENT DOCUMENTS

| | | | | |
|---|---|---|---|---|
| 4,131,423 | A | 12/1978 | Kato | |
| 4,536,907 | A | 8/1985 | Zumbrunn et al. | |
| 5,034,016 | A | 7/1991 | Koshida et al. | |
| 5,061,290 | A | 10/1991 | Koshida et al. | |
| 5,494,491 | A * | 2/1996 | Gurley | C09B 7/02 8/625 |
| 2004/0172774 | A1* | 9/2004 | Birkinshaw | D06P 1/221 8/519 |
| 2005/0032449 | A1 | 2/2005 | Lovasic et al. | |
| 2005/0204488 | A1 | 9/2005 | Hartgrove et al. | |
| 2006/0059634 | A1 | 3/2006 | Tutterow | |
| 2006/0059635 | A1 | 3/2006 | Alpert | |
| 2008/0280519 | A1 | 11/2008 | Rodriguez | |
| 2014/0007356 | A1* | 1/2014 | Kunnure | D06P 5/137 8/401 |
| 2014/0053348 | A1* | 2/2014 | Finley | D06P 5/002 8/543 |

FOREIGN PATENT DOCUMENTS

| | | | | |
|---|---|---|---|---|
| ES | 8406600 | A1 | 11/1984 | |
| ES | 2 059 745 | T3 | 11/1994 | |
| ES | 2 060 047 | T3 | 11/1994 | |
| JP | H10-280286 | A | 10/1998 | |
| KR | 10-2012-0076096 | A | 7/2012 | |
| WO | 2012/016124 | A2 | 2/2012 | |
| WO | WO2012/085747 | * | 6/2012 | D06P 1/56 |

OTHER PUBLICATIONS

UNE-EN 31092 "Textiles. Determinación de las propiedades fisiológicas. Medida de la resistencia térmica y de la resistencia al vapor de agua en condiciones estacionarias (ensayo de la placa caliente protegida de la transpiración) (ISO 11092:1193)." "Textiles. Determination of physiological properties. Measurement of thermal and water vapour resistance under steady state conditions (sweat guarded-hotplate test.) (ISO11092:1193)"; Feb. 1996 (total of 15 pages).

International Search Report of PCT/ES2014/070696, dated Nov. 4, 2014.

* cited by examiner

*Primary Examiner* — Amina S Khan
(74) *Attorney, Agent, or Firm* — Collard & Roe, P.C.

(57) ABSTRACT

This invention relates to a Denim protective fabric, with fire-retardant properties, and the process of dyeing the warp with indigo blue dye on a mixture of cellulosic and synthetic fibers, in order to obtain a permanently fire-retardant fabric, resistant to flame, heat, breaking, tearing, cutting and abrasion by impact. The resulting fabric is also antistatic and can be considered as a protective fabric like fire-retardant Denim and also a multi-risk fabric. The indigo blue dye is applied on a mixture of cellulosic and synthetic fibers with permanently fire-retardant properties such as fire-retardant viscose, fire-retardant modal, modacrylic, polyacrylate, polyamide, polyester, antistatic carbon, para-aramid, meta-aramid, polyamide-imide, polyethylene, PBI, with the aim of obtaining an authentic Denim jeans fabric, with the characteristics of the tincture based on indigo blue dye that loses its color on rubbing, with use and washing.

6 Claims, 1 Drawing Sheet

DENIM FABRIC WITH FIRE-RETARDANT PROPERTIES AND PROCESS OF DYEING THE WARP WITH INDIGO BLUE DYE

CROSS REFERENCE TO RELATED APPLICATIONS

This application is the National Stage of PCT/ES2014/070696 filed on Sep. 12, 2014, which claims priority under 35 U.S.C. § 119 of Spanish Application No. P201331462 filed on Oct. 4, 2013, the disclosure of which are incorporated by reference. The international application under PCT article 21(2) was not published in English.

OBJECT OF THE INVENTION

This invention refers to a Denim Fabric with fire-retardant properties, its formula and a new process of dyeing the warp with indigo blue dye on a mixture of cellulosic and synthetic fibres with permanent fire-retardant properties, such as fire-retardant viscose, fire-retardant modal, modacrylic, polyacrylate, polyamide, fire-retardant polyester, antistatic carbon, para-aramid, meta-aramid, polyamide-imide, polyethylene, PBI, etc., with the aim of obtaining a typical authentic Denim Jean fabric with the features of the tincture with indigo blue dye that loses its colour with rubbing, with use and washing.

The product obtained is permanently fire-retardant, resistant to flame, heat and at the same time, due to the construction of the fabric, is also resistant to breaking, tearing, cutting, abrasion by impact, antistatic, and can be considered to be a fire-retardant denim-type fabric with multi-risk protection.

BACKGROUND OF THE INVENTION

Denim fabric is defined as that in which the warp of the fabric, normally of cellulosic fibres, is mainly dyed with indigo blue dye and that with rubbing and use and/or washing with mechanical or chemical means gradually loses its colour. The main property of indigo blue dye and the type of dyeing process is that the dye is deposited on the yarn in superficial concentric rings and that the tincture does not penetrate inside the yarn and fibres.

There are also fabrics on the market with a Denim appearance that are dyed with other types of dye, including sulphurous, pigmented, direct prior cationization of the yarn, etc. But these fabrics are not defined as authentic Denim but are imitations and do not have the properties of Denim dyed with indigo blue dye.

There are various types of Denim fabric or with the appearance of Denim that have fire-retardant properties; the most important of which are listed below:

Denim fabrics made fire-retardant by a process of finishing the fabric by foulard (dipping bath), dyed with indigo, sulphurous, acidic or pigmented dyes, with or without prior cationization, where these fabrics, which could be of various types of composition such as 100% cotton fabric or a mixture of mostly cotton with polyester or cotton with polyamide 6.6, or cotton with Lyocell, etc., are made fire-retardant by a process of finishing by foulard, continuous or by wringing, also having finishes with chemical treatments based on phosphoric acids such as Proban® and Secan®.

Other types of fabrics are those that imitate the appearance of Denim fabric and are based on permanently fire-retardant fibres dyed in bulk, in flock, skein or crossed reel with a colour that imitates indigo blue colour. These fabrics are used as warp yarns and are woven with whitish ecru colour yarns, preferably linked with 3/1 or 2/1 twill weaves to obtain fabrics that visually imitate the appearance of a Denim fabric, but do not wash out and lose colour with washing or rubbing with use (example: Kermel®).

Yarns are also known that are used for producing fabrics such as those previously mentioned, preferably obtained by conventional cotton spinning processes, also using open-end yarns, and in some cases yarns from worsted spinning, being able to use all yarns with an end twisted by a conventional system, and there are also parallel yarns covered by core-twist technology (e.g. polyester, polyamide, polyamide-imide, meta-aramid, para-aramid). These yarns are used for the core in the core-twist spinning process, which consists of covering a yarn of normally continuous parallel and non-textured filaments so that a core or continuous normally synthetic and non-textured internal yarn is covered by a double helicoidal covering of two cut fibre yarns. The texturing and increase in volume and matting of the continuous yarn is obtained by friction or Airtex discs.

With respect to finishes, there are chemical products on the market to obtain a fire-retardant finish on 100% cotton fabric, or a mixture of cotton with synthetic fibres, based on chemical compounds where the active ingredient is mainly phosphoric acid or tris(aziridinyl)phosphine oxide (APO), being normally applied by foulard and wringing, thermofixing for polymerisation, with a subsequent reduction wash and rinsing to remove residual product and finally neutralising the pH of the fabric.

The usual process based on impregnation and crosslinking polymerisation treatment is as follows:

- Firstly, the fabric is prepared by drying to remove excess moisture.
- Secondly, the cotton fabric is treated with a chemical solution containing phosphoric acid in a process of impregnation by foulard, so that the dry fabric is cured using ammonia gas in the curing process, which causes the small molecules to join to form a polymer, which is cross-linked and bound to the core of each of the fibres.
- Next an oxidation process is performed and finally the cloth is washed thoroughly in a 1.2% reducing bath at 60° C., rinsing in water and a subsequent neutralisation, followed by drying at 130° C. for one minute.
- Another fire-retardant finishing system is based on cross-linking with hydroxy-functional organophosphorus oligomer.

The drawbacks or unresolved issues presented by these aforementioned processes are as follows:

- This range of fabrics cannot guarantee to be permanently fire-retardant, nor retain the initial level of fire-retardant performance because they lose these properties after washing, which is necessary for keeping the fabric in use.
- These types of finish also leave the fabric more rigid, reducing its comfort and the chemical agent used can cause allergies in some people.
- The fabrics are obtained from synthetic or artificial fibres such as meta-aramid, para-aramid, polyamide-imide, PBI, modacrylic, chlorofibres, all fabrics that are not comfortable because they do not have natural or cellulose fibres in their composition.
- There are fibres that imitate indigo colour, but the colour does not fade on use and washing like authentic Denim, and normally use uniform colours.
- There are fabrics composed of fibres that do not have good hygroscopicity, or capillarity, so therefore they do not absorb or regulate moisture, resulting in poor breathability with low Rec and Ret values (according to EN 31092 standard Determination of the physiological/thermal properties and to water vapour).

The yarns used for this fabric range are obtained by conventional cotton spinning processes, using open-end yarns, that are twisted by conventional systems, in some cases applying yarns obtained by worsted spinning and parallel yarns coated by core-twist technology.

Finally, the yarns obtained, as well as the resulting fabrics, are characterised by being rigid and rough to the touch.

In any case, documents corresponding to patents are known that refer to or are related to indigo dyeing processes. In this sense, document ES2059745 refers to some compositions of dyes for dyeing drill cotton yarn and a process for dyeing and articles dyed using this process, claiming a dyeing process that involves immersion of the yarn in an indigo bath, with a phase of draining and one of oxidation by ventilation of the dyed yarn.

There is also document ES2060047, that concerns a process of dyeing strands using an indigo derivative and the dyed article obtained by this process that comprises repeated immersion in a dye bath, draining of excess liquid and oxidation by exposure to air.

There is another document U.S. Pat. No. 4,131,423 that refers to a process for dyeing cellulosic fibres that enables binding of the tincture by oxidation treatment.

Another document is ES8406600 that refers to a process of neutralisation of cellulosic substrates impregnated with a free or bound alkaline metal hydroxide, performing the neutralisation in situ by contact with a neutralising fluid containing carbon dioxide.

Another document is the patent US20060059635 that refers to a method that enables satisfactory adhesion of the tincture on the surface of fibres by the preparation of a bath including dye or sulphur dye pigment particles and some additives that cause the pigment to be electrically charged. Next, a second additive is applied, in this case on the textile material to create a substrate with opposite polarity to the first polarity created. Then the textile material is immersed in the prepared bath to cause the pigment particles to be attracted by the substrate and retained. Finally, the retained pigment particles are chemically reduced and then the reduced pigment particles are oxidised to form the pigments within the textile material.

Another document that may be mentioned is patent US2008280519 that refers to a process for dyeing cotton fibres mixed with synthetic fibres for the manufacture of coloured "Jeans" by a direct or cationic dye, so that a colour-fast cloth is obtained that will not be washed out or discoloured with use or washing as with indigo. However, after study it was observed that the process comprises a scouring stage where the yarn passes through a water bath at 40-90° C. containing a cationic wetting agent, the dyeing stage contains a buffer solution and water at 60-90° C. with a cationic dye, the concentration of which varies between 0.05 and 500 g/l, then a first wash, a stage of binding the dye to the cloth by a water bath at room temperature and an anionic arylsulphonate binding at a concentration of 80 to 120 g/l and, finally, a second wash.

Another document is Korean patent KR20120076096 A, where a process is described that involves the use of natural indigo in powder for dyeing "Jeans", which may be of Lycra or Denim, comprising the stages of drying, powdering the indigo, mixing the powder with hydrosulphite, sodium hydroxide and water, treating at 40-60° C. for 20-40 minutes, immersion of the pair of "Jeans" in the dyeing solution, oxidation, washing, neutralisation with acetic acid and washing.

Another document is patent US2005204488 that refers to a process for dyeing natural or cellulosic fibres combined with artificial fibres with indigo dye, where the natural fibre is at least 10%. This document refers to the impregnation of the unwoven fabric in a bath containing leuco-indigo dye.

Finally, there is a document corresponding to a Japanese patent JPH10280286 A, describing dyeing of synthetic yarn with indigo using a conventional process.

In any of these cases, that is in all the processes described in the documents listed above, a complete process of indigo dyeing of synthetic fibres with fire-retardant properties, as described in this patent application, is not performed.

DESCRIPTION OF THE INVENTION

The invention refers to a Denim fabric consisting of a mixture of cellulosic and synthetic fibres mixed with fire-retardant fibres, that comprises a warp where the yarns are dyed with indigo blue dye using a novel process. It also comprises ecru coloured weft yarns similar in type to the mixture, which may be rigid or elastic depending on the final use of the fabric, characterised in that it is a protective fabric, permanently fire-retardant and also resistant to flames, traction, abrasion by impact and with multi-risk protection.

To date, it has not been possible to dye synthetic fibres with indigo blue dye or with other dye families that enable the dyeing of warp yarns by the rope, slasher or foam dyeing systems. The invention resides in a formula and the process for dyeing and finishing that enables dyeing fibres consisting of synthetic polymers with these dyes. Previously, it was only possible to dye cellulosic based fibres to obtain Denim fabrics.

Traditionally, dyeing of synthetic fibres such as polyester, polyamide, modacrylic and other varieties was performed with suitable dyes that are related to these materials such as the family of disperse dyes, acidic and cationic, and typical processes of continuous dyeing or discontinuous dyeing by wringing.

In the process of the invention, there are a series of operational phases that will be described later, where the aim is to obtain a indigo blue Denim-type fabric that loses colour in successive washes and with use, with fire-retardant properties, using the following coating fibres: fire-retardant viscose, fire-retardant modal, cotton, modacrylic, polyester, polyamide or fire-retardant polyamide, meta-aramid, para-aramid, polyacrylate, polyacrylonitrile and others.

Furthermore, in the process of the invention, the warp of the fabric is dyed with indigo blue dye based on a new method of dyeing Denim that enables dyeing fibres consisting of synthetic polymers, wherein to date only cellulosic based fibres could be dyed.

The dyeing of the warp yarns comprises the following phases: the PREPARATION phase of the material based on PRE-DYEING with impregnation of indigo blue dye in a bath or by foam at a temperature of 50° C., to obtain a good intensity of dye on the cellulosic fibres. This pre-dyeing process uses surfactants with a mixture of anionic surfactants together with the indigo blue dye (a small percentage of sulphurous dye can also be added to increase the tint) and the amounts of NaOH and sodium dithionite reducing agent necessary.

In order to obtain the maximum coverage of the indigo dye on the cellulosic materials of the yarn used, and to attempt a colouration by pigment staining of the synthetic materials, the time of impregnation is increased from that used for dyeing 100% cellulosic fibres to be of between 115 to 136 seconds, feeding the warp yarn at a speed of between 22 and 27 m/min.

Furthermore a nitrogen generator is used to create an inert atmosphere in the impregnation and dyeing boxes that enables having the indigo dye in reduced form during the time it is held in this nitrogen atmosphere, thereby avoiding possible oxidation of the dye in contact with the oxygen of the ambient air, and being able to dye the cellulosic fibres with the maximum dye coverage on the fibres and obtain a deposition of reduced indigo dye on the synthetic fibres (enables the reduced form of the indigo dye, leuco-indigo, and in an inert nitrogen atmosphere, to deposit over the non-cellulosic synthetic fibre, as if it were cellulosic).

Moreover, the amount of reducing agent (sodium dithionite) is increased by 130% to 150% and the amount of alkali (NaOH) is increased, making the indigo remain in its chemically reduced state inside the impregnation box, which together with the nitrogen atmosphere helps to maintain greater reduction of the indigo dye during the reduction process. This ensures pigmentation of the synthetic fibres, so that with these concentrations and in combination with the impregnation time (of between 115 to 136 seconds) and the generated nitrogen atmosphere, a deposition of the indigo on the cellulosic fibre and a colouration of the synthetic fibres is obtained, achieving a total annular coating of the fibres comprising the yarn.

After excess moisture has been removed by a spinning process, the yarn is next subjected to an OXIDATION phase by passing it through an air oxidation field, using the oxygen contained in the atmosphere (standard atmosphere) in order to complete total oxidation of the dye on the cellulosic fibre and ensure complete Van der Waals chemical reaction between the dye and the cellulose, and also converting the indigo dye deposited on the synthetic fibres in a reduced form into a pigmented form to obtain the colouration of the synthetic fibres.

To achieve this, the oxidation time was increased from the order of 80 seconds to 95 seconds compared to conventional oxidation processes (contact with the environmental O2).

When the indigo dye is oxidised, the yarn is CATIONIZED using quaternary amines, which bind the indigo dye on the synthetic fibres and at the same time cationize the cellulosic fibres for the subsequent treatment of the tincture with indigo dye.

The process continues with a WASHING AND DRYING of the yarn to remove all the unbound products and to prepare it for dyeing.

The DYEING phase in the process of the invention comprises at least 5 consecutive cycles of the process of pre-dyeing and subsequent oxidation of the yarn as previously described, so that each cycle deposits a concentric ring of indigo dye on the yarn, obtaining an annular dyeing, in superficial rings on the yarn, so characteristic of the indigo blue tincture on Denim articles. The number of cycles will depend on the intensity of the colour desired and of the % of indigo that is required on the weight of the fibre (% indigo of fibre weight).

Next, there is a FINISHING phase so that after achieving dyeing with blue indigo dye on the cellulose and its binding by subsequent oxidation, the indigo blue dye is chemically bound on the synthetic fibres applying a fixer with cationic polymers based on epichlorohydrin that remains integrated in the final structure and binding the indigo dye deposited in pigment form. Next, a drying stage is applied in order to polymerise the cationic polymer to obtain a microfilm coating on the indigo pigment obtained, by chemical reaction, integrating it molecularly on the synthetic fibres.

At the end of this process, the tincture on the yarn and its fibres has the characteristic of indigo blue tincture in concentric or annular rings, both over the cellulosic fibres and the synthetic, so that by rubbing with use or by the mechanical or chemical effect of washing, the appearance of lighter tones can be obtained because the interior of the yarn is not dyed and, depending on the number of dyeing and oxidation cycles performed, dyeing of the fibres to values of between 1.5% and 2.7% of indigo per weight of fibre can be achieved (percentage of indigo per weight of fibre).[*]

A following phase is that of GLUEING OR sizing, with the aim of protecting the warp threads from continuous rubbing and tension to which they will be subjected during the weaving process, applying vinyl copolymers that ensure the elimination of the possible formation of splicing and bobbling in the weaving process, so these vinyl copolymers act to improve the binding of the indigo pigment deposited on the synthetic material.

In a subsequent phase, there is a drying process, that must operate at temperatures no higher than 120° C. to prevent differences in elasticity and stretching of the various materials after they are glued.

It should also be said that in the process it is necessary to subject the yarns to tensioning for the duration of the continuous dyeing process, based on a mechanism consisting of traction control sensors on the yarns that enable controlling and correcting the tension applied throughout the process.

In summary, by the process of the invention, the same effect obtained in the process of conventional indigo dyeing of cellulosic fibres is obtained but on natural or synthetic cellulosic fibres and their mixtures with synthetic fibres. An indigo blue Denim-type tincture in rings is obtained on a mixture of cotton, viscose or fire-retardant modal, modacrylic, high tenacity antistatic polyamide, para-aramid and/or polyethylene in a continuous process resulting in the dyeing of the cotton and FR modal in a conventional way, whereas the modacrylic, polyamide, para-aramid and polyethylene fibres are superficially pigmented with indigo dye in an inert nitrogen atmosphere, oxidised and finally bound together with cationic polymer and by subsequent polymerisation as described above. A fabric is obtained with the authentic Denim appearance where the fabrics are characterised by being mostly composed of fibres of natural or synthetic origin and partially of cellulose, obtaining fire-retardant articles with a LOI (Limiting Oxygen Index) of greater than 20.

The advantages of the product obtained based on the process of the invention, a product that is a protective Denim-type fire-retardant fabric permanently dyed with indigo blue dye that is fire resistant, flame resistant and also resistant to breaking, cutting, abrasion, impact, is antistatic and multi-risk, can be summarised as follows:

- It is fire-retardant, ensured for the whole life cycle of the product (fibres intrinsically permanently fire-retardant).
- It is a fabric that loses colour with use and successive washing and has an appearance identical to that of Indigo Blue Denim Jeans.
- It is a breathable fabric.
- It is an antistatic fabric, providing protection from static electrical discharges.
- It is a hypo-allergenic fabric. (Because it does not cause any type of allergy and especially when compared with fabrics made fire-retardant by finishing processes).
- It is traction resistant (>300 N) and tear resistant (>15 N).

It is resistant to cutting and abrasion by impact.

It is resistant to UV light and micro-organisms.

It is easy to maintain and is washable.

It is a protective fabric with many uses, in glass workshops, ironing workshops, gardening work, farm and forestry work, cementing, construction, automotive, motorcycling, cycling, skate boarding, skating, hiking, transport, police work, military operations, etc.

The fabrics obtained by the process of the invention are based on the use of yarns with core-spun technology, formed by a central core and an external covering, where the central core is a high tenacity continuous yarn and the external covering is obtained by injecting two or more roving fibres with subsequent torsion and stretching of these rovings, obtaining as a result yarns characterised by having more flexibility, better feel, better visual appearance and better coverage of the nucleus or core compared to those existing on the market of the core-twist type, and better resistance than a conventional yarn.

In the case of warp yarns used, these are constituted with one or more cores of continuous textured or non-textured yarn, obtaining the covering by injection or feeding two or more rovings of fibres containing fire-retardant fibres or a mixture of fire-retardant fibres and natural or synthetic cellulosic fibres.

The yarns used as the core may have a core of polyester, high tenacity polyester, high tenacity polyamide 6.6, polyamide 6.6, carbon ceramic fibre, high molecular weight polyethylene, para-aramid and meta-aramid, while the fibres used for the covering are those already mentioned at the start of this description and are natural, artificial and/or synthetic fibres that contain cellulose and can be mixed with fire-retardant viscose, fire-retardant modal, modacrylic, polyamide, fire-retardant polyamide, meta-aramid, para-aramid, polyamide-imide, polyacrylate, polyacrylonitrile, chlorofibres, vinyl fibres, silica, PBI, PBO, PTO, Kynol.

These yarns also have the property of being permanently fire-retardant and antistatic because of the covering fibres used, are resistant to abrasion, breakage, tearing, cutting and to impact due to the core used.

The fabrics made with these yarns are normally 3×1 twill and 2×1 twill weaves but can also be taffetas, sateens, satins, telethons, double-sided fabrics or double fabrics, etc.

When the fabric has been made, it passes through a final finishing process where it is gassed to remove superficial fibres preventing the indigo subliming from the warp with temperature, they may be washed or not to remove the glueing products that have been added to the yarn during the process of finishing the tincture, tinted with indigo foam on the good side of the fabric and sanforized to prevent shrinkage with washing and use that garments made with these fabrics may suffer.

In summary, the fabric of the invention has the following fundamental features:

It is a permanently fire-retardant Denim fabric.

The warp and weft yarns are mixtures of permanently fire-retardant fibres.

The warp yarn is dyed with indigo blue dye.

It is an elastic fabric with fire-retardant fibres.

The LOI is greater than 20.

It has yarns of core-spun technology to increase the resistances.

It is a multi-risk and protective fabric.

All these features are based on a process of dyeing the yarn and a finishing that are different from the conventional process.

DESCRIPTION OF THE FIGURES

To complement the description below and with the aim of helping to reach a better understanding of the characteristics of the invention, this document is accompanied by a set of FIGS. that form an integral part of the document and can be used to understand specific features of the novelty of the invention, and these FIGS. show the following.

PREFERRED EMBODIMENT OF THE INVENTION

Figure 1:
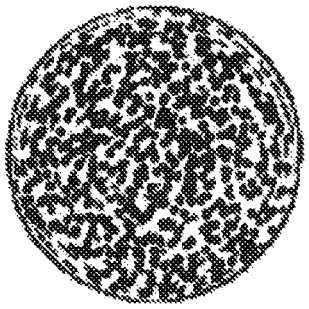
FIG. 1. Shows a schema of the traditional dyeing process of a synthetic fibre with dyes related to these materials that are applied to the fabrics.
Figure 2:
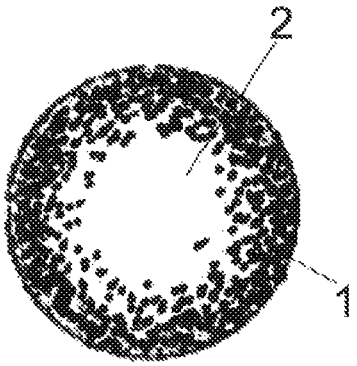
FIG. 2. Shows the tincture applied according to the invention.

As described above, FIG. 1 shows traditional dyeing of a synthetic fibre with dyes that are similar to such materials, while FIG. 2 shows tincture applied according to the invention, forming concentric rings (1), or in other words, superficial layers, leaving the central nucleus (2), that is the core of the yarn, without dye, because the dye does not penetrate to the nucleus of the yarn.

Figure 3:
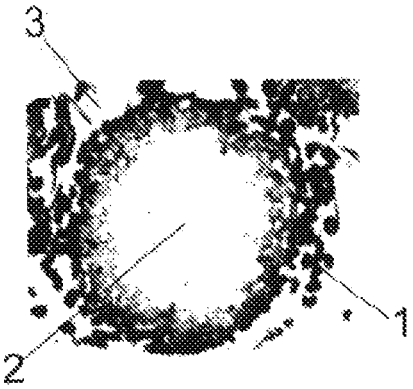
FIG. 3. Shows a cross section of a cotton yarn dyed with indigo dyes viewed under a microscope, all performed in accordance with the object of the invention.

Finally, FIG. 3 shows a cross section of a cotton yarn (3) that has been dyed with indigo dyes, in accordance with the Denim dyeing process shown in FIG. 2, viewed through a microscope.

The invention claimed is:

1. A process of dyeing the warp yarns of a denim fabric with indigo blue dyes, the warp yarns having a mixture of permanently fire-retardant fibres that contain natural, cellulosic and synthetic fibres, wherein the dyeing is performed continuously in a dyeing indigo machine and the fire-retardant fibres have intrinsic fire-retardant properties, comprising the following steps in order:

in a preparation phase:

preparing the warp yarns by applying a first dye in the form of reduced indigo blue dye to the warp yarns to obtain pigmentation of the synthetic fibres;

oxidizing the warp yarns by subjecting them to air to oxidize the dye on the cellulosic fibres and to convert the reduced dye deposited on the synthetic fibres into a pigmented form, fixing the first dye on the synthetic fibres by cationization with quaternary amines, and washing the warp yarns to remove dye that is not fixed on the synthetic fibres;

in a dyeing phase:

applying reduced indigo dye to the warp yarns to obtain pigmentation of the synthetic fibres; and oxidizing the warp yarns by subjecting them to air to oxidize the dye on the cellulosic fibres and to convert the reduced dye deposited on the synthetic fibres into a pigmented form, wherein the dyeing phase is repeated in consecutive cycles;

in a finishing phase:

binding the dye on the synthetic fibres via application of a cationic polymer;

drying the warp yarns, polymerizing the cationic polymer with the indigo dye on the synthetic fibres to achieve an integration of the indigo dye on the structure of the synthetic fibres; and in a gluing phase:

applying vinyl copolymers to the warp yarns, and drying the warp yarns to fix the vinyl copolymers on the warp threads.

2. The process according to claim 1, wherein the reduced indigo blue dye is mixed with anionic surfactants and other dyes to obtain dyeing of the yarns by transformation of the indigo dye after oxidation.

3. The process according to claim 1, wherein the indigo blue dye is reduced with sodium dithionite and caustic soda.

4. The process according to claim 1, wherein the steps of applying the dye are undertaken in an inert atmosphere created with a nitrogen generator.

5. The process according to claim 1, wherein the dyeing phase is performed in consecutive cycles that obtain concentric rings of indigo dye tincture on the yarn.

6. The process according to claim 1, wherein the dyeing phase is repeated until the fibers contain between 1.5% and 2.7% by weight of indigo dye after the finishing phase is completed.

* * * * *